US009033148B2

(12) United States Patent
Adams

(10) Patent No.: US 9,033,148 B2
(45) Date of Patent: May 19, 2015

(54) KNIFE SHEATH

(75) Inventor: Philip Peter Adams, Kirkville, NY (US)

(73) Assignee: Philip P. Adams, Kirkville, NY (US)

( * ) Notice: Subject to any disclaimer, the term of this patent is extended or adjusted under 35 U.S.C. 154(b) by 371 days.

(21) Appl. No.: 13/553,802

(22) Filed: Jul. 19, 2012

(65) Prior Publication Data

US 2013/0026054 A1 Jan. 31, 2013

Related U.S. Application Data

(60) Provisional application No. 61/512,719, filed on Jul. 28, 2011.

(51) Int. Cl.

| | |
|---|---|
| ***A45C 11/26*** | (2006.01) |
| ***A45F 5/14*** | (2006.01) |
| ***A45F 5/02*** | (2006.01) |
| ***B26B 29/02*** | (2006.01) |

(52) U.S. Cl.

CPC . *A45F 5/14* (2013.01); *A45F 5/021* (2013.01); *B26B 29/025* (2013.01); *A45F 2200/0591* (2013.01); *Y10S 224/904* (2013.01)

(58) Field of Classification Search

USPC ..... 206/349, 775; 224/232, 233, 904, 242, 224/191; 30/143

See application file for complete search history.

(56) References Cited

U.S. PATENT DOCUMENTS

| | | | | |
|---|---|---|---|---|
| 3,008,617 | A * | 11/1961 | Villwock | 224/183 |
| 3,514,022 | A * | 5/1970 | Eastman | 224/232 |
| 6,718,639 | B1 * | 4/2004 | Kazanjian | 30/138 |
| 8,069,570 | B2 * | 12/2011 | Taylor et al. | 30/143 |
| 2002/0170843 | A1 * | 11/2002 | Dieter et al. | 206/553 |
| 2003/0126746 | A1 * | 7/2003 | Yu | 30/161 |
| 2007/0266569 | A1 * | 11/2007 | Nenadic | 30/151 |
| 2011/0290690 | A1 * | 12/2011 | Myllymaki | 206/372 |
| 2014/0069831 | A1 * | 3/2014 | Miyawaki | 206/349 |

* cited by examiner

*Primary Examiner* — Jacob K Ackun

(57) ABSTRACT

A sheath for a knife is ventilated or is formed with gaps in a way that sand and other debris cannot collect to dull the knife's blade. The sheath holds the knife, protects and safely covers the sharp edge, but does not provide a surface for abrasive sand to dull the edge. The sheath can include front and rear panels, held together with a plurality of spacers disposed between the panels. The spacers can be rounded to as to minimize contact between the spacers and the blade of the knife.

3 Claims, 3 Drawing Sheets

KNIFE SHEATH

CROSS-REFERENCE TO RELATED APPLICATION

This application claims the benefit of priority of U.S. provisional application number 61/512,719, filed Jul. 28, 2011, the contents of which are herein incorporated by reference.

BACKGROUND OF THE INVENTION

The present invention relates to a knife sheath and, more particularly, to a knife sheath that passively removes abrasive dust and sand to maintain a sharp blade edge.

Conventional knife sheaths, whether made from leather, metal or plastic, all are designed to hold a knife and protect the edge from exposure for safe carry. These knife holding systems (sheaths) are designed around a traditional system that is basically a flat pocket. The same opening that the knife is inserted and removed from allows sand (abrasives) into the blade storage area of the sheath, creating an abrasive blade storage area.

Present military troops in a desert environment have difficulty maintaining a sharp edge on their knives due to the fine gritty sand collecting in their knife sheaths. The removal and reinsertion of a knife blade from conventional knife sheaths abrades the knife edge, dulling it. In addition, these conventional closed sheaths are not easily cleanable.

As can be seen, there is a need for an improved knife sheath that does not collect debris, can be easily cleaned and helps keep a knife stored in the sheath sharp and ready to use.

SUMMARY OF THE INVENTION

In one aspect of the present invention, a knife sheath comprises a front panel; a back panel disposed alongside of the front panel; and a plurality of spacers disposed between the front panel and the back panel, the spacers being spaced apart from each other to permit abrasive debris to pass through the knife sheath.

In another aspect of the present invention, a knife sheath comprises a front panel; a back panel disposed alongside of the front panel; a plurality of spacers disposed between the front panel and the back panel, the spacers being spaced apart from each other to permit abrasive debris to pass through the knife sheath; screws connecting the front panel to the back panel, the screws securing the plurality of spacers; and a locking trigger operable to resiliently press against a knife disposed in the knife sheath, retaining the knife within the sheath, wherein the plurality of spacers are tubular members having a rounded edge facing inside the sheath.

These and other features, aspects and advantages of the present invention will become better understood with reference to the following drawings, description and claims.

DETAILED DESCRIPTION OF THE INVENTION

Figure 1:
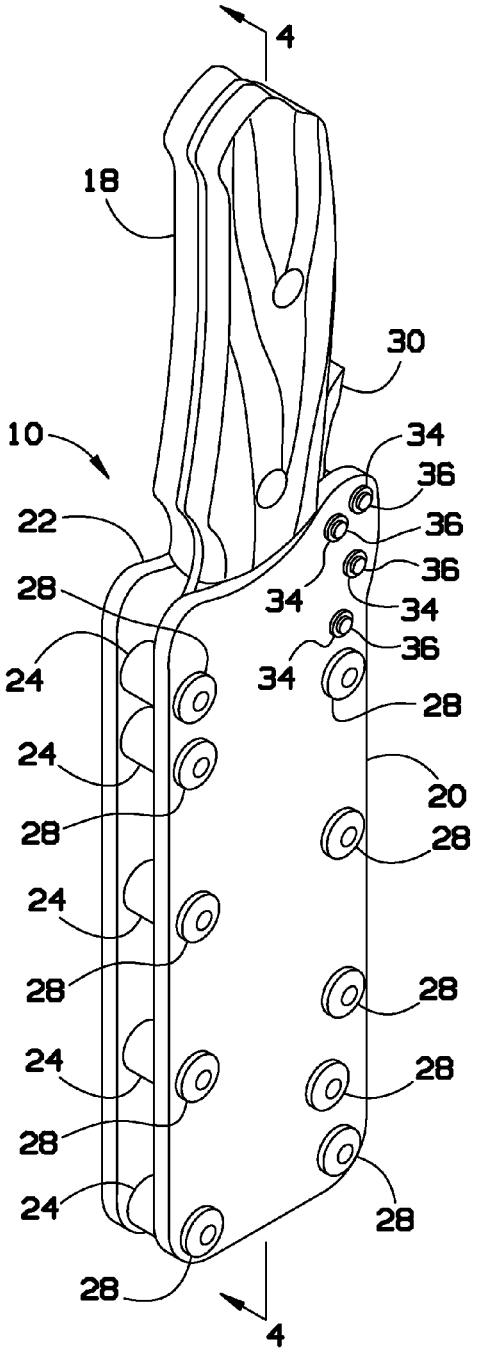
FIG. 1 is a perspective view of a knife disposed in a knife sheath according to an exemplary embodiment of the present invention.
Figure 2:
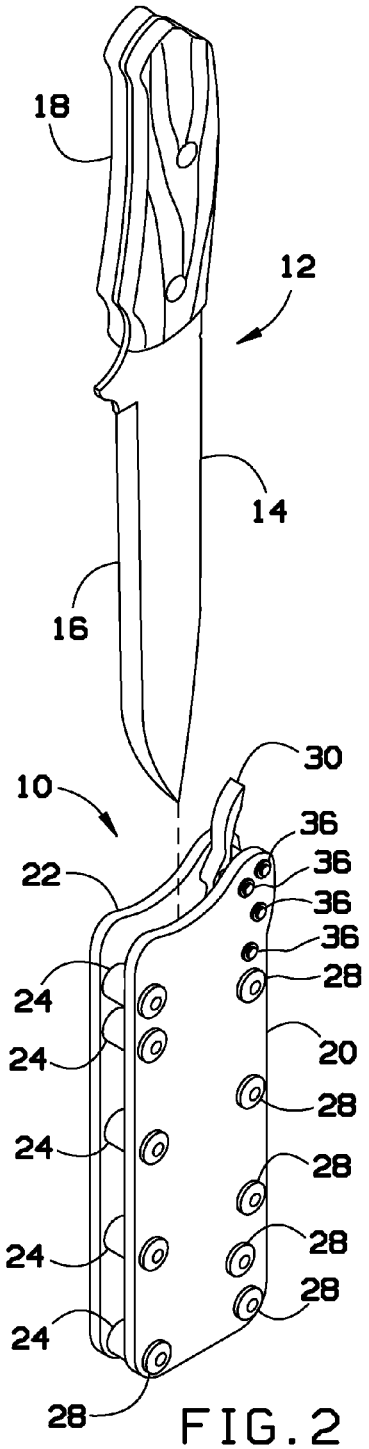
FIG. 2 is a perspective view showing the knife removed from the sheath of FIG. 1.
Figure 3:
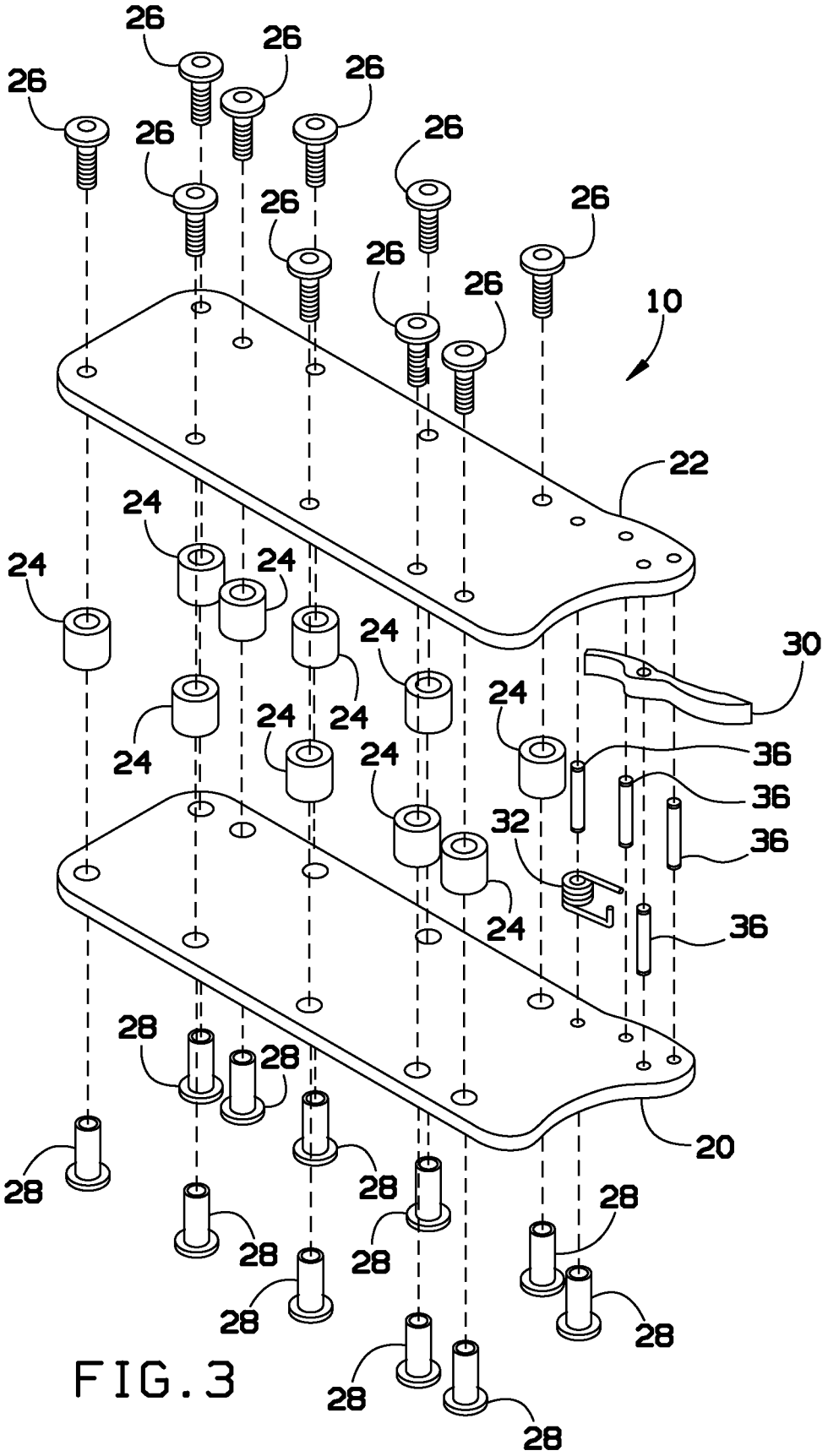
FIG. 3 is an exploded perspective view of the knife sheath of FIG. 1.
Figure 4:
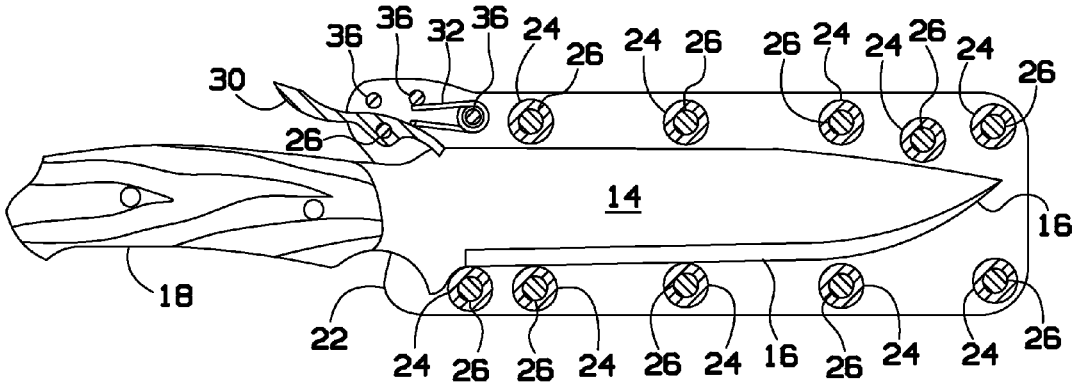
FIG. 4 is a cross-sectional view taken along line 4-4 of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a sheath for a knife that is ventilated or is formed with gaps in a way that sand and other debris cannot collect to dull the knife's blade. The sheath holds the knife, protects and safely covers the sharp edge, but does not provide a surface for abrasive sand to dull the edge. The sheath can include front and rear panels, held together with a plurality of spacers disposed between the panels.

Referring now to FIGS. 1 through 4, a locking knife sheath 10 can be adapted to hold a knife 12. The knife 12 can include a knife blade 14 with a blade edge 16 that does not rub against sand inside the sheath 10 when the blade 14 is inserted into or removed from the sheath 10, as the sheath 10 is ventilated, with front and back panels 20, 22 spaced apart from each other. The knife blade 14 can be attached to a knife handle 18 which extends from the sheath 10 when the knife 12 is disposed in the sheath 10.

The front panel 20 and the back panel 22 can be joined together with a plurality of male screws, such as male Chicago screws 26, which interconnect with a plurality of female screws, such as female Chicago screws 28. A plurality of spacers 24 can be disposed the front panel 20 and the back panel 22 and the screws 26, 28 can pass through the spacers 24.

A locking trigger 30 can be disposed on one side of a top end of the sheath 10. The locking trigger 30 can pivot about a grooved pin 36 that can be disposed between the front panel 20 and the back panel 22. A c-clip 34 can be disposed on each end of the grooved pin 36 to keep the pin 36 disposed between the panels 20, 22. Additional grooved pins 36 can be disposed between the panels 20, 22 to help control the movement of the locking trigger 30. A spring 32 can be disposed to resiliently urge the locking trigger 30 in a locked position, where the locking trigger 30 can retain the knife 12 within the sheath 12. The user can resiliently urge the locking trigger 30 away from the knife 12 to remove the knife 12 from the sheath 10.

The spacers 26 may be made of a material that the blade 16 of the knife 12 can move along with damage thereto. For example, the spacers 26 can be made of nylon. The spacers 26 can be, for example, about 3/16 inch thick and about 3/8 inch in diameter. Various quantities of spacers 26 can be used. In some embodiments, the spacers can be spaced about 1.5 inches apart around the perimeter of the two parallel panels 20, 22. The spacers 26 provide a gap to prevent abrasive sand collection inside the sheath 10.

The panels 20, 22 can be made of various flat, strong material, such as Kydex, sheet aluminum, or the like. The panels 20, 22 can be from about 0.05 to about 0.20 inch thick, for example. The spacers 26 are typically shaped with a rounded or curved shape to minimize contact between the blade 16 and the spacer 26.

Figure 5:
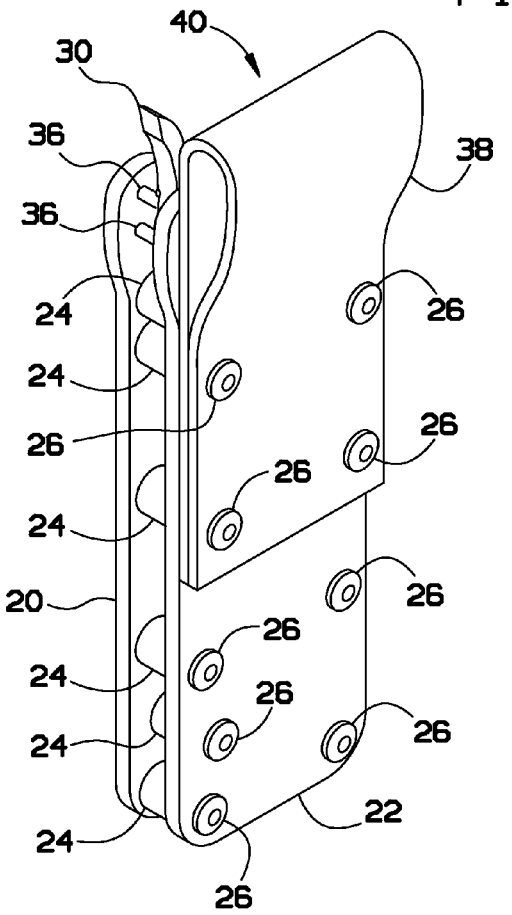
FIG. 5 is a perspective view of a knife sheath having a belt loop connected thereto, according to an exemplary embodiment of the present invention.

Referring now to FIG. 5, a knife sheath 40 can be designed with its back panel 22 having a belt loop 38. The belt loop 38 can be connected to the back panel 22 with a plurality of the screws 26. The belt loop 38 can be used to attach the sheath 40 to a belt, an ankle holster, or the like.

Figure 6:
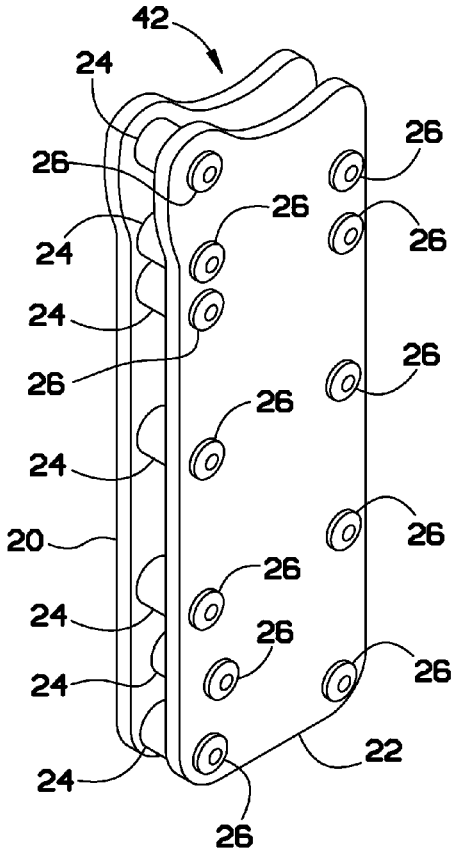
FIG. 6 is a perspective view of a knife sheath, without a locking mechanism included therewith, according to another exemplary embodiment of the present invention.

Referring to FIG. 6, a knife sheath 42 can be designed without the locking trigger 30 as shown in FIGS. 1 through 4. In this embodiments, without the locking trigger 30, the grooved pins 36 and the c-clips 34 are also not used. Otherwise, the knife sheath 42 can be designed similar to the knife sheath 10 described above.

The sheaths 10, 40, 42 described above can be used in various applications, in particular military and tactical applications, but may also be used, for example, for survival tools in desert environments. The sheath allows sand and debris that would collect in a conventional sheath, to flow through and out of the sheath.

While the above describes the sheath for storing bladed items, such as knives, the sheath of the present invention can be used to carry other items, include non-blade items that may be damaged by the abrasive effects of sand.

It should be understood, of course, that the foregoing relates to exemplary embodiments of the invention and that modifications may be made without departing from the spirit and scope of the invention as set forth in the following claims.

What is claimed is:

1. A knife sheath comprising:

a front panel;

a back panel disposed alongside of the front panel;

a plurality of spacers disposed between the front panel and the back panel, the spacers being spaced apart from each other to permit abrasive debris to pass through the knife sheath;

screws connecting the front panel to the back panel, the screws securing the plurality of spacers; and a locking trigger operable to resiliently press against a knife disposed in the knife sheath, retaining within the sheath, wherein the plurality of spacers are tubular members having a rounded edge facing inside the sheath.

2. The knife sheath of claim 1, further comprising:

a spring urging one end of the locking trigger to pivot against the knife; and a plurality of grooved pins extending between the front panel and the back panel, the grooved pins retaining the locking trigger and spring in place.

3. The knife sheath of claim 1, further comprising a belt loop attached to the back panel fo the knife sheath.

* * * * *